US006634875B2

(12) United States Patent
Imamura et al.

(10) Patent No.: US 6,634,875 B2
(45) Date of Patent: Oct. 21, 2003

(54) SCROLL COMPRESSOR HAVING AN OLDHAM'S RING CONTAINING SILICON PARTICLES

(75) Inventors: Hiroyuki Imamura, Shimizu (JP); Kazuo Sakurai, Kanbara (JP); Keiji Tanaka, Fujieda (JP); Yasuro Ohishi, Fujieda (JP); Kiyoshi Fukatsu, Shimizu (JP); Motoshi Hayashi, Toyota (JP); Shinya Nakamura, Toyota (JP); Akira Takenaka, Toyota (JP)

(73) Assignees: Hitachi Air Conditioning Systems Co., Ltd., Tokyo (JP); Taiho KOgyo Co., Ltd., Toyota (JP)

( * ) Notice: Subject to any disclaimer, the term of this patent is extended or adjusted under 35 U.S.C. 154(b) by 0 days.

(21) Appl. No.: 10/099,970

(22) Filed: Mar. 19, 2002

(65) Prior Publication Data

US 2002/0131883 A1 Sep. 19, 2002

(30) Foreign Application Priority Data

Mar. 19, 2001 (JP) ..... 2001-077926

(51) Int. Cl.[7] ..... F04C 18/04; F16D 3/04
(52) U.S. Cl. ..... 418/55.3; 464/102
(58) Field of Search ..... 418/55.3; 464/102

(56) References Cited

U.S. PATENT DOCUMENTS 5,131,356 A * 7/1992 Sick et al. ..... 123/193.2
6,511,226 B2 * 1/2003 Thompson et al. ..... 384/420

FOREIGN PATENT DOCUMENTS

| | | | |
|---|---|---|---|
| JP | 60013991 | | 1/1985 |
| JP | 60019972 | | 2/1985 |
| JP | 3-206383 | | 9/1991 |
| JP | 6-81779 | | 3/1994 |
| JP | 9-176770 | * | 7/1997 |

OTHER PUBLICATIONS

Patent Abstracts of Japan 03–206383 Sep. 9, 1991.
Patent Abstracts of Japan 06–081779 Mar. 22, 1994.

* cited by examiner

*Primary Examiner*—John J. Vrabilk
(74) *Attorney, Agent, or Firm*—Antonelli, Terry, Stout & Kraus, LLP

(57) ABSTRACT

An improved scroll compressor comprises a fixed scroll and an orbiting scroll, as well as an Oldham's coupling which enables the orbiting scroll to have a orbital movement. The Oldham's ring of the Oldham's coupling is so formed that its sliding surfaces for counterpart members to slide thereon are formed by a base material containing silicon particles, while the surface of each silicon particle (remaining on the base material's surface serving as a slidable surface for counterpart members to slide thereon) is formed into a flat surface. In practice, a ratio of silicon portions formed into flat surfaces to an entire sliding area of the Oldham's coupling is in a range of 3% to 20%, preferably 5% to 15%. With the use of the scroll compressor of the present invention, it is possible to improve the wear resistance of the Oldham's ring of the Oldham's coupling and its counterpart members in the scroll compressor.

9 Claims, 4 Drawing Sheets

SCROLL COMPRESSOR HAVING AN OLDHAM'S RING CONTAINING SILICON PARTICLES

BACKGROUND OF THE INVENTION

1. Field of the Invention

The present invention relates to a scroll compressor for compressing a coolant or an air, particularly to a scroll compressor having a orbiting scroll and an Oldham's coupling comprising an Oldham's ring for providing a swing or orbital movement to the orbiting scroll, with the sliding parts of the Oldham's coupling having an improved wear resistance.

2. Description of the Related Art

Since a scroll compressor has a higher efficiency, a higher reliability and a lower operation noise than compressors of other types, it has been widely used in various fields in industry, such as in a freezer or in an air conditioner.

Such a scroll compressor includes a fixed scroll fixed in the compressor's frame structure, and an orbiting scroll located in a position opposite to the fixed scroll. The fixed scroll has a circular base plate providing a spiral wrap structure formed thereon. Similarly, the orbiting scroll also has a circular base plate providing a spiral wrap structure formed thereon. The fixed scroll and the orbiting scroll are arranged in a manner such that both spiral wrap structures are mutually engaged with each other. In this way, when the orbiting scroll is caused to perform an orbiting movement with respect to the fixed scroll, a fluid like a gas to be compressed can be continuously compressed so as to be discharged.

In general, a scroll compressor is formed such that in order to enable the orbiting scroll to have a orbital movement, a motor is connected with the back surface of the base plate of the orbiting scroll via a crank shaft, and an Oldham's ring of an Oldham's coupling is provided between the back surface of the base plate of the orbiting scroll on one hand and the said frame structure on the other. In fact, such an Oldham's ring is formed by a ring-like member. On either surface of the Oldham's ring there are formed two projections (Oldham's keys) in the diameter direction of the Oldham's ring. However, the two projections formed on one surface of the Oldham's ring and another two projections formed on the other surface of the Oldham's ring in such a manner that every two adjacent projections are separated from each other by an angle of 90 degrees in the circumferential direction of the Oldham's ring.

On the other hand, key grooves are formed on the frame structure of the scroll compressor and on the back surface of the base plate of the orbital scroll. The two projections (Oldham's keys) formed on one surface of the Oldham's key are freely slidably engaged in the grooves formed on the back surface of the base plate of the orbiting scroll, while another two projections formed on the other surface of the Oldham's ring are freely and slidably engaged in the grooves formed on the frame structure. In this way, when the crank shaft is rotatably driven by the motor, the respective projections of the Oldham's ring of the Oldham's coupling will be forced to move reciprocatingly in and along the grooves formed on the frame structure and the grooves formed on the back surface of the base plate, thereby rendering the orbiting scroll to have a orbital movement.

However, since the respective projections of the Oldham's ring of the Oldham's coupling are caused to move reciprocatingly in and along the grooves formed on the frame structure and the grooves formed on the back surface of the base plate, these projections are easy to wear away. In particular, when a load (key load) acting on the projections are large, the surface pressure acting on the sliding surface of the projections of the Oldham's ring (sliding in and along the grooves formed on the frame structure and the grooves formed on the back surface of the base plate) will be increased. As a result, it will be difficult for an lubricant oil to form a continuous layer or film on the sliding surface of each projection, resulting in a problem that the projections will be worn away easier.

Furthermore, in recent years, with the use of an inverter-controlled speed-variable scroll compressor, an ON/OFF frequency is reduced and the discharge amount of compressor is continuously controlled according to an actual load. In this way, an attempt has been made trying to save energy, and under such a situation, since a low speed rotation of a scroll compressor will cause the projections to slide at a low speed, it is difficult to form an oil film or a continuous oil layer on the sliding surface of each projection, resulting in a problem that the projections will be worn away too soon.

Further, in the case where HFC coolant that does not contain chlorine molecules is used, the sliding surface of each projection will have a low lubricity. As a result, under a condition where key load has become large and sliding speed has become low, an abrasion amount on each projection will be undesirably increased.

In view of the above, there has been suggested that when an Oldham's ring of an Oldham's coupling is made of an aluminium material, the sliding surface of each projection is subjected to an electric plating treatment called SiC-dispersed plating, so that each projection is allowed to obtain an improved wear resistance (Japanese Unexamined Patent Application Publication No. 3-906383). In addition, there has also been suggested that when an Oldham's ring of an Oldham's coupling is made of a sintered iron, the sliding surface of each projection is subjected to a surface treatment to form an iron boride film thereon, so that each projection is allowed to obtain an improved wear resistance (Japanese Unexamined Patent Application Publication No. 6-81779).

However, the above-described conventional treatments have been found to be associated with the following problems. Namely, the electric plating treatment called SiC-dispersed plating makes it necessary to conduct a size management in order to control the thickness of each electric plating layer, but fails to avoid an abrasion on each projection when a plating layer has peeled off from its original position.

In the case where the sliding surface of each projection is subjected to a surface treatment in order to form an iron boride film thereon, although the hardness of each projection can be increased, there will be an abrasion on each counterpart member on which a corresponding projection slides, i.e., there will be an abrasion on the key grooves formed on the frame structure as well as on the back surface of the base plate of the orbiting scroll.

On the other hand, although it is allowed to consider enlarging the sliding area on each projection so as to increase its wear resistance, however, enlarging sliding area will require the Oldham's coupling to be made in a large size. As a result, each conventional scroll compressor has to be modified significantly in its structure, which is however practically impossible.

SUMMARY OF THE INVENTION

Accordingly, it is an object of the present invention to provide an improved scroll compressor by increasing the wear resistance of its Oldham's keys of the Oldham's coupling and its counterpart members, that is so called Oldham's key grooves, sliding therewith.

In order to arrive at the above object, there is provided a scroll compressor comprising a fixed scroll having a base plate and a spiral wrap structure formed on the base plate; a orbiting scroll having a base plate and a spiral wrap structure formed on the base plate, said orbiting scroll being set in a manner such that the spiral wrap structure of the orbiting scroll is engaged with the spiral wrap structure of the fixed scroll; an Oldham's ring provided between the back surface of the base plate of the orbiting scroll and a frame structure of the scroll compressor; and a driving means connected to the back surface of the base plate of the orbiting scroll through a crank shaft, capable of cooperating with the Oldham's ring to cause the orbiting scroll to have a orbital movement. In particular, the Oldham's ring is so formed that at least its sliding surfaces allowing the back surface of the base plate of the orbiting scroll as well as the frame structure to slide thereon, are formed by a base material and silicon contained in the base material, the surfaces of silicon remaining on said sliding surfaces are formed into flat surfaces, a ratio of silicon portions formed into flat surfaces to an entire sliding area of the Oldham's ring is in a range of 3% to 20%, preferably 5% to 15%.

With the use of the above construction, it is possible to improve the wear resistance of the sliding surfaces of the Oldham's ring of the Oldham's coupling. Further, in the case where the surfaces of silicon remaining on the sliding surfaces of the Oldham's ring are formed into flat surfaces, since the base material will be slightly cut away in a comparison with the silicon, an oil film or layer may be formed in each of the recess portions between each particle of the silicon formed by such cutting. In this way, it is allowed to properly maintain a lubricating oil in these recess portions, thus effectively inhibiting an abrasion on the back surface of the base plate of the orbiting scroll (serving as a counterpart member for the Oldham's ring of the Oldham's coupling) as well as an abrasion on the frame structure of the scroll compressor (also serving as a counterpart member for the Oldham's ring of the Oldham's coupling). At this time, if the base material contains too much silicon, the area of the recess portions (formed by cutting) of the base material will become smaller, rendering it difficult to keep the lubricating oil on these recess portions. On the other hand, if the base material contains too little silicon, it will be impossible to maintain a desired wear resistance on the sliding surface of the base material. For this reason, in the present invention, a ratio of silicon portions formed into flat surfaces to an entire sliding area of the base material is in a range of 3% to 20%, preferably 5% to 15%.

Further, according to the present invention, the silicon is an initial crystal silicon in the form of silicon particles having a size of 100 $\mu$m or smaller, preferably 50 $\mu$m or smaller. If the particle size is too large, the area of the recess portions (formed by cutting) will become small, rendering it difficult to maintain a lubricating oil in these recess portions. For this reason, silicon particles are formed into a size of 100 $\mu$m or smaller, preferably 50 $\mu$m or smaller. Further, the initial crystal silicon has a high hardness as well as an excellent wear resistance.

The base material forming the Oldham's ring of the Oldham's coupling may be a metal containing aluminium.

Moreover, the Oldham's ring of the Oldham's coupling may be formed by forging or die-casting. In this way, it is possible to manufacture the Oldham's ring at a reduced cost and with an improved productivity.

DESCRIPTION OF THE PREFERRED EMBODIMENTS

Next, an embodiment of the present invention will be described in the following with reference to the accompanying drawings.

Figure 1:
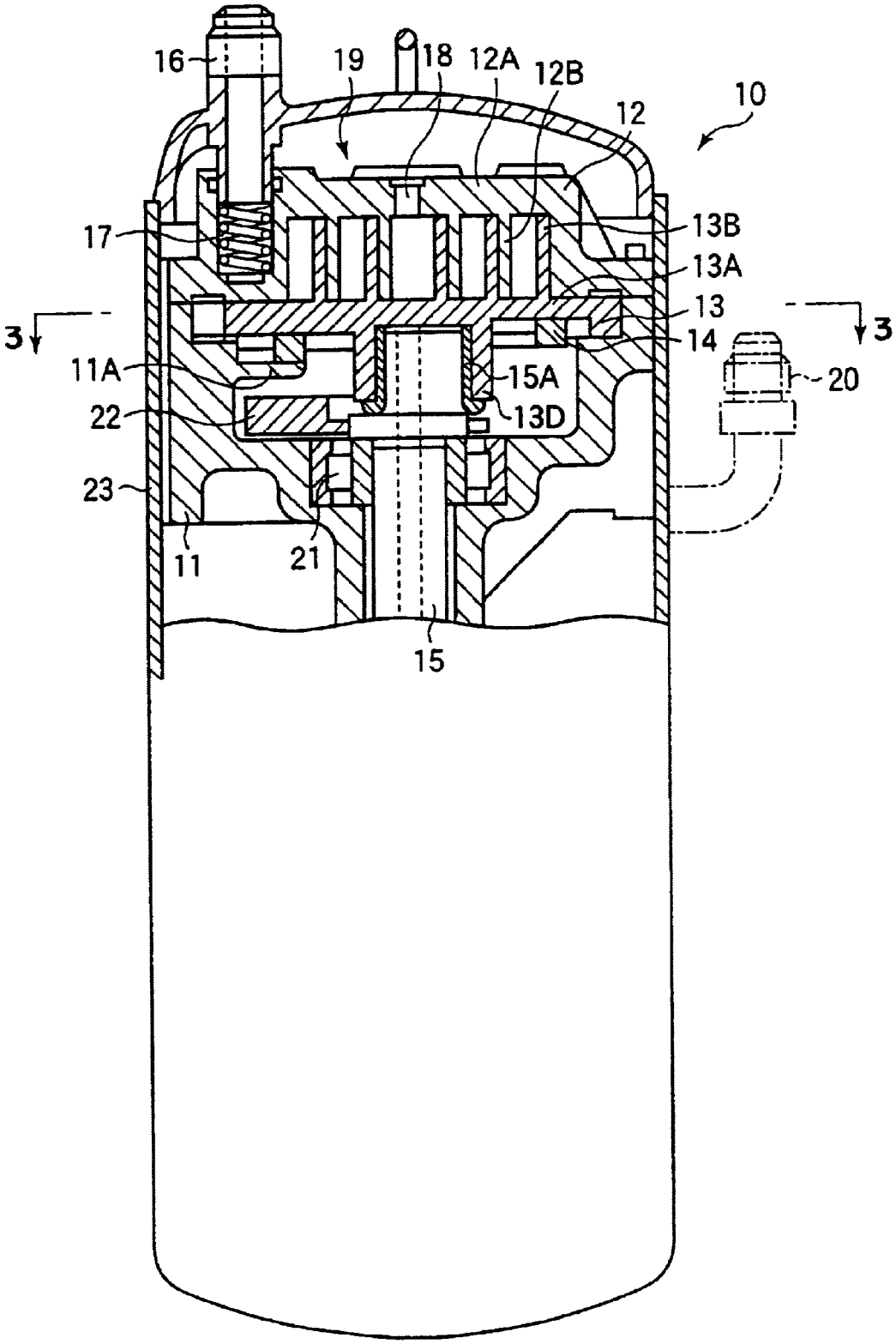
FIG. 1 is a front view which has been partially broken to show the structure of a scroll compressor formed according to the present invention.

FIG. 1 shows the structure of the scroll compressor formed according to the present invention. In general, the scroll compressor 10 comprises, as its principle or main components, a fixed scroll 12 fixed in a frame structure 11 of the scroll compressor, a orbiting scroll 13 disposed in a position opposite to the fixed scroll 12, an Oldham's ring 14 of an Oldham's coupling provided between the orbiting scroll 13 and the frame structure 11, and a driving unit or means (not shown) which is connected to the orbiting scroll 13 through a crank shaft 15 and enables the orbiting scroll 13 to have a swing or orbital movement by cooperating with the Oldham's ring 14. Specifically, the fixed scroll 12 has a base plate 12A circular in its shape, with a spiral wrap structure 12B formed thereon. Similarly, the orbiting scroll 13 also has a base plate 13A circular in its shape, with a spiral wrap structure 13B formed thereon. In fact, the fixed scroll 12 and the orbiting scroll 13 are disposed in a manner such that the spiral wrap structure 12B and the spiral wrap structure 13B are mutually engaged with each other. In this way, by virtue of the swing or orbital movement of the orbiting scroll 13, it is allowed to compress a fluid sucked from an inlet pipe 16 through an inlet port 17, thereby allowing the compressed fluid to be discharged to an upper space 19 through a discharge port 18 located in the center of the base plate 12A. Subsequently, the fluid discharged to the upper space 19 is guided to the outside of the compressor through a discharge pipe 20.

Figure 4:
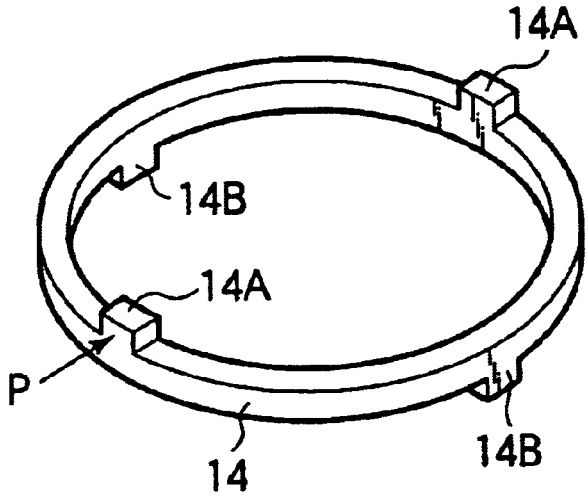
FIG. 4 is a perspective view showing the Oldham's ring.
Figure 5:
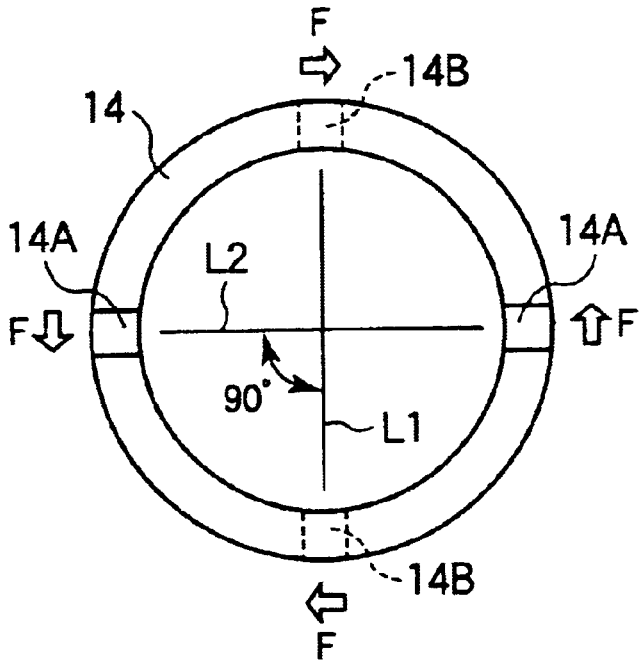
FIG. 5 is a plan view showing the Oldham's ring.

The Oldham's ring 14 provided between the orbiting scroll 13 and the frame structure 11 is formed by a ring-like member shown in FIG. 4, with one side (upper surface) thereof having two projections (Oldham's keys) 14A, 14A and the other side (lower surface) thereof having another two projections (Oldham's keys) 14B, 14B. In fact, the projections 14A, 14A are arranged in a diameter direction of the ring-like member, while the projections 14B, 14B are arranged in another diameter direction of the ring-like member. Further, the projections 14A, 14A and the projections 14B and 14B are arranged in the circumferential direction of the ring-like member, with an angular interval of 90 degrees formed between every two adjacent projections. In other words, as shown in FIG. 5, if the two projections 14A, 14A are connected with each other by a straight line L2 and another two projections 14B, 14B are connected with each other by another straight line L1, an angle of 90 degrees will be formed between the two straight lines L1 and L2.

Figure 2:
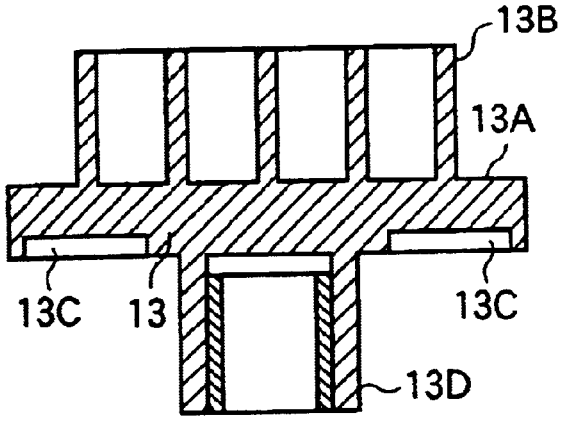
FIG. 2 is a longitudinally sectional view showing an orbiting scroll used in the scroll compressor.
Figure 3:
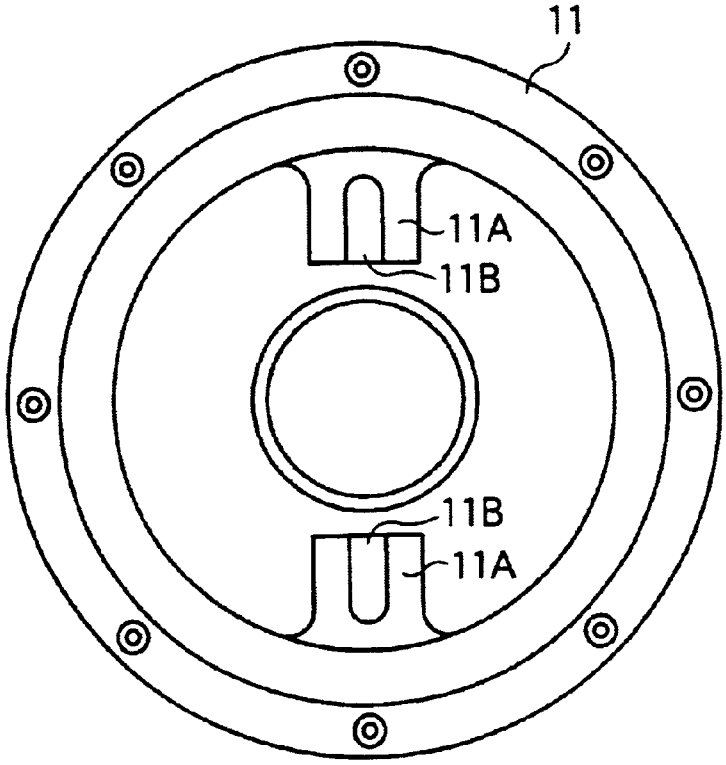
FIG. 3 is an explanatory view taken along 3—3 line in FIG. 1, showing a frame structure supporting the scroll compressor, with its orbiting scroll and its Oldham's ring removed from the state shown in FIG. 1.

Furthermore, as shown in FIG. 2, grooves (Oldham's key grooves) 13C are formed on the back surface of the base plate 13A of the orbiting scroll 13. The projections 14A of the Oldham's ring 14 are freely slidably engaged in the grooves 13C. On the other hand, as shown in FIG. 3, grooves (Oldham's key grooves) 11B are formed on a frame base 11A, and the projections 14B of the Oldham's ring 14 are freely slidably engaged in the grooves 11B. In addition, as shown in FIG. 1, a boss portion 13D is formed in an eccentric position on the back surface of the base plate 13A of the orbiting scroll 13, while a crank pin 15A on the tip end of the crank shaft 15 is slightly movably engaged in the boss portion 13D.

Now, referring again to FIG. 1, reference numeral 21 is used to represent a bearing member for freely rotatably supporting the crank shaft 15, while reference numeral 22 is used to represent a balance weight provided on the crank shaft 15. Further, reference numeral 23 is used to represent a sealed container. Various elements forming the scroll compressor of the present invention are accommodated within the sealed container 23.

The above-described construction is so formed that during the operation of the scroll compressor, a rotation torque will act on the orbiting scroll 13. At this time, the Oldham's ring 14 will act to receive such a rotation torque by virtue of an engagement of the projections 14A, 14B of the Oldham's ring 14 into the grooves 11B formed on the frame structure 11, as well as an engagement of the same projections 14A, 14B into the grooves 13C formed on the back surface of the base plate 13A of the orbiting scroll 13, thereby stopping the rotation of the orbiting scroll 13. For this reason, as shown in FIG. 5, a gas load as well as a centrifugal load (represented by F in the drawing) will act, as a force for receiving and stopping the rotation torque, on the projections 14A, 14B of the Oldham's ring 14, in a direction orthogonal to the sliding direction of the projections 14A and 14B.

In the present embodiment, the said gas load as well as the centrifugal load or centrifugal forth are all caused to act on the projections 14A, 14B of the Oldham's ring. These loads and forth act to cause an abrasion on the projections 14A, 14B and the grooves 11B of the frame structure 11 or the grooves 13C of the orbiting scroll 13. In order to prevent such an abrasion, in accordance with this embodiment, the projections 14A and 14B may be kept in a state shown in FIG. 6. In particular, the projections 14A and 14B are formed by a base material 31 containing silicon particles 32, while the surface 32A of each silicon particle 32 (remaining on the base material's surface which serves as a sliding surface for other counterpart members to slide thereon) is formed into a flat surface. In practice, a ratio of silicon portions 32 formed into flat surfaces to an entire sliding area of the Oldham's coupling is in a range of 3% to 20%, preferably 5% to 15%. Further, the silicon particles 32 remaining on the sliding surface of the base material are made of an initial crystal silicon having a high hardness and having a particle size of 100 $\mu$m or smaller, preferably 50 $\mu$m or smaller. That is, the maximum size of silicon particle is 100 $\mu$m or smaller, preferably 50 $\mu$m or smaller. On the other hand, the base material 31 is formed by an eutectic aluminium containing an aluminium and a silicon.

When the surfaces 32A of the silicon particles 32 remaining on the sliding surface of the base material are formed into flat surface, since the base material 31 is relatively soft as compared with silicon particles, the base material 31 is easier to cut away than the silicon particles. As a result, the surfaces of the silicon particles 32 are slightly higher than the surface of the base material 31. In other words, the surfaces of the silicon particle 32 stand out slightly from the surface of the base material 31. Further, since it is allowed to keep a lubricating oil in the recess portions (formed by cutting between the silicon particles) on the base material 31, not only is it possible to inhibit an abrasion on the projections 14A and 14B, but also to inhibit an abrasion of the grooves 13C of the orbiting scroll 13 as well as an abrasion of the grooves 11B of the frame structure 11 (all acting as counterpart elements). At this time, if the base material contains too much of the silicon particles, an area of the recess portions (formed by cutting) on the base material 31 will become smaller, rendering it difficult to keep the lubricating oil on the recess portions. On the other hand, if the base material contains too few of the silicon particles, it will be impossible to maintain a desired wear resistance on the sliding surface of the base material. For this reason, in the present embodiment, a ratio of silicon portions formed into flat surfaces to an entire sliding area of the Oldham's coupling is in a range of 3% to 20%, preferably 5% to 15%.

On the other hand, the reasons as to why the silicon particles should have a size of 100 $\mu$m or smaller (preferably 50 $\mu$m or smaller) may be explained as follows. Namely, if the particle size is too large, a total area of the recess portions (formed by cutting) will become small, rendering it difficult to maintain a lubricating oil in the recess portions. Material used in the present invention to form silicon particles is an initial crystal silicon having a high hardness and an excellent wear resistance.

The Oldham's ring 14 may be formed by forging or die-casting an appropriate material. In this way, it is possible to manufacture the Oldham's ring with an improved yield and at a reduced cost.

Figure 6:
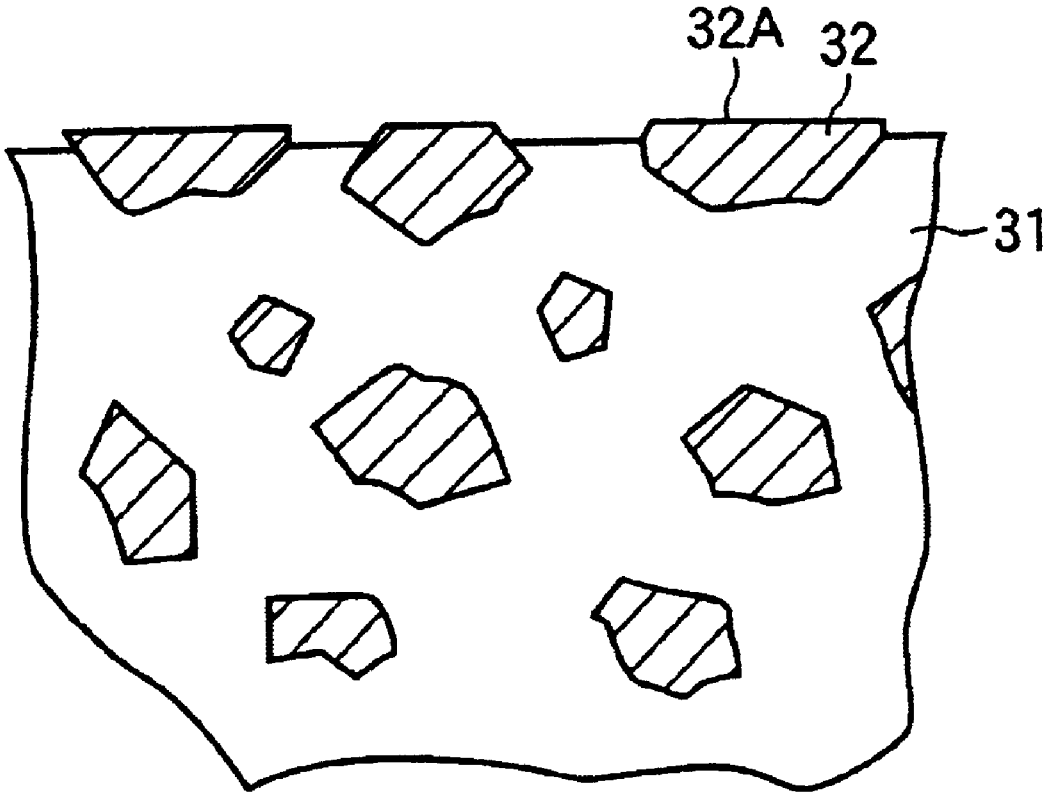
FIG. 6 is an enlarged cross sectional view showing the composition of a projection (Oldham's key) formed on the Oldham's ring.

Although in the present embodiment only the projections 14A and 14B of the Oldham's ring 14 are formed into a structure shown in FIG. 6, it is also possible that the entire Oldham's ring 14 may be formed into the structure shown in FIG. 6. In addition, it is also possible that the projections 14A and 14B are so formed that only their sliding surfaces allowing counterpart members to slide thereon, are each formed into the structure shown in FIG. 6.

Further, it is also possible to form the sliding surface of Oldham's key grooves by a base material containing silicon particles.

As described in the above, with the use of the present invention, it is possible to improve the wear resistance of both the Oldham's ring of the Oldham's coupling and its counterpart members.

What is claimed is:

1. A scroll compressor comprising:

a fixed scroll having a base plate and a spiral wrap structure formed on the base plate;

an orbiting scroll having a base plate and a spiral wrap structure formed on the base plate, said orbiting scroll being set in a manner such that the spiral wrap structure of the orbiting scroll is engaged with the spiral wrap structure of the fixed scroll;

an Oldham's ring of an Oldham's coupling provided between the back surface of the base plate of the orbiting scroll and a frame structure; and a driving means connected to the back surface of the base plate of the orbiting scroll through a crank shaft, capable of cooperating with the Oldham's ring to cause the orbiting scroll to have a orbital movement, wherein the Oldham's ring is so formed that at least its sliding surfaces allowing the back surface of the base plate of the orbiting scroll as well as the frame structure to slide thereon, are formed by a base material and silicon contained in the base material, the surfaces of silicon remaining on said sliding surfaces are formed into flat surfaces, and a ratio of silicon portions formed into flat surfaces to an entire sliding area of the Oldham's ring is in a range of 3% to 20%.

2. A scroll compressor according to claim 1, wherein the silicon is an initial crystal silicon in the form of silicon particles having a maximum size of 100 mm.

3. A scroll compressor according to claim 1, wherein the surfaces of silicon stands out from the surface of the base material.

4. A scroll compressor according to claim 1, wherein the base material forming the Oldham's ring contains aluminium.

5. A scroll compressor according to claim 1, wherein the Oldham's ring is formed by forging.

6. A scroll compressor according to claim 1, wherein the Oldham's ring is formed by die-casting.

7. A scroll compressor according to claim 1, wherein the ratio of the silicon portions formed into flat surfaces of the entire sliding area of the Oldham's ring is in a range of 5 to 15%.

8. A scroll compressor according to claim 1, wherein the silicon is an initial crystal silicon in the form of silicon particles having a maximum size of 50 $\mu$m.

9. A scroll compressor according to claim 2, wherein the base material forming the Oldham's ring is softer than the silicon particles.

* * * * *